US011527196B2

(12) United States Patent
Tseng et al.

(10) Patent No.: US 11,527,196 B2
(45) Date of Patent: Dec. 13, 2022

(54) DRIVING CIRCUIT AND ELECTRONIC DEVICE FOR DRIVING LIGHT EMITTING UNIT

(71) Applicant: Innolux Corporation, Miao-Li County (TW)

(72) Inventors: Ming Chun Tseng, Miao-Li County (TW); Kung-Chen Kuo, Miao-Li County (TW); Lien-Hsiang Chen, Miao-Li County (TW); Chi Lun Kao, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/474,057

(22) Filed: Sep. 14, 2021

(65) Prior Publication Data

US 2022/0114952 A1 Apr. 14, 2022

(30) Foreign Application Priority Data

Oct. 12, 2020 (CN) ..... 202011083634.X

(51) Int. Cl.
*G09G 3/32* (2016.01)

(52) U.S. Cl.
CPC ..... *G09G 3/32* (2013.01); *G09G 2300/0842* (2013.01)

(58) Field of Classification Search
CPC ..... G09G 3/32; G09G 2300/0842; G09G 2320/045; G09G 3/3233; G09G 2300/0861; G09G 2300/0819; G09G 2300/0852; G09G 2320/0219
See application file for complete search history.

(56) References Cited

U.S. PATENT DOCUMENTS

2009/0225013 A1 9/2009 Lee et al.
2014/0225878 A1 8/2014 Shih et al.
2015/0356924 A1* 12/2015 Chen ..... G09G 3/3291 345/77
2019/0237019 A1* 8/2019 Gao ..... G09G 3/3233
2020/0090579 A1* 3/2020 Chen ..... G09G 3/32

FOREIGN PATENT DOCUMENTS

EP 3624105 3/2020

OTHER PUBLICATIONS

"Search Report of Europe Counterpart Application", dated Mar. 11, 2022, p. 1-p. 9.

* cited by examiner

*Primary Examiner* — Muhammad N Edun
(74) *Attorney, Agent, or Firm* — JCIPRNET

(57) ABSTRACT

A driving circuit for driving a light emitting unit is provided. The driving circuit includes a driving transistor, a switch transistor, an emitting transistor, a first capacitor and a first compensation transistor. The switch transistor is coupled to the driving transistor. The emitting transistor is coupled between the light emitting unit and the driving transistor. The first capacitor is coupled to the driving transistor. The first compensation transistor is coupled to the first capacitor. A first end of the first compensation transistor and a first end of the emitting transistor receive same signal.

20 Claims, 7 Drawing Sheets

200

DRIVING CIRCUIT AND ELECTRONIC DEVICE FOR DRIVING LIGHT EMITTING UNIT

CROSS-REFERENCE TO RELATED APPLICATION

This application claims the priority benefit of Chinese application serial no. 202011083634.X, filed on Oct. 12, 2020. The entirety of the above-mentioned patent application is hereby incorporated by reference herein and made a part of this specification.

BACKGROUND

Technical Field

The disclosure relates to a driving circuit, in particular to a driving circuit and an electronic device for driving a light emitting unit.

Description of Related Art

For current display panels, such as light emitting diode (LED) display panels, organic light emitting diode (OLED) display panels, sub-millimeter light emitting diode (mini LED) display panels, or micro light emitting diodes (micro LED) display panels, most of their driving circuits are manufactured using process technologies such as low temperature poly silicon (LTPS), amorphous silicon (a-Si) or oxide thin-film transistor (oxide TFT), which leads to variation in the characteristics of the circuit components of the driving circuits due to the aforementioned processes, resulting in errors in the output voltage. For example, when the threshold voltage of the thin-film transistor varies, the output voltage of the thin-film transistor will be in error. Moreover, when more thin-film transistors are included in the driving circuit, the switching action of these thin-film transistors will have non-ideal bias influence on the voltage level of the gate of the thin-film transistor due to the parasitic capacitive coupling effect.

SUMMARY

The disclosure proposes a special circuit design structure for a driving circuit and an electronic device for driving a light emitting unit, which may effectively compensate a driving transistor in the driving circuit.

According an embodiment of the disclosure, the driving circuit for driving the light emitting unit of the disclosure includes a driving transistor, a switch transistor, an emitting transistor, a first capacitor, and a first compensation transistor. The switch transistor is coupled to the driving transistor. The emitting transistor is coupled between the light emitting unit and the driving transistor. The first capacitor is coupled to the driving transistor. The first compensation transistor is coupled to the first capacitor. A first end of the first compensation transistor and a first end of the emitting transistor receive same signal.

According to an embodiment of the disclosure, the electronic device of the disclosure includes a substrate, a light emitting unit, and a driving circuit. The light emitting unit is disposed on the substrate. The driving circuit is disposed on the substrate. The driving circuit drives the light emitting unit, and the driving circuit includes a driving transistor, a switch transistor, an emitting transistor, a first capacitor, and a first compensation transistor. The switch transistor is coupled to the driving transistor. The emitting transistor is coupled between the light emitting unit and the driving transistor. The first capacitor is coupled to the driving transistor. The first compensation transistor is coupled to the first capacitor. A first end of the first compensation transistor and a first end of the emitting transistor receive same signal.

Based on the above, the driving circuit and the electronic device for driving the light emitting unit of the disclosure may effectively compensate voltage of the driving transistor in the driving circuit through designing compensation transistors in the driving circuit.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
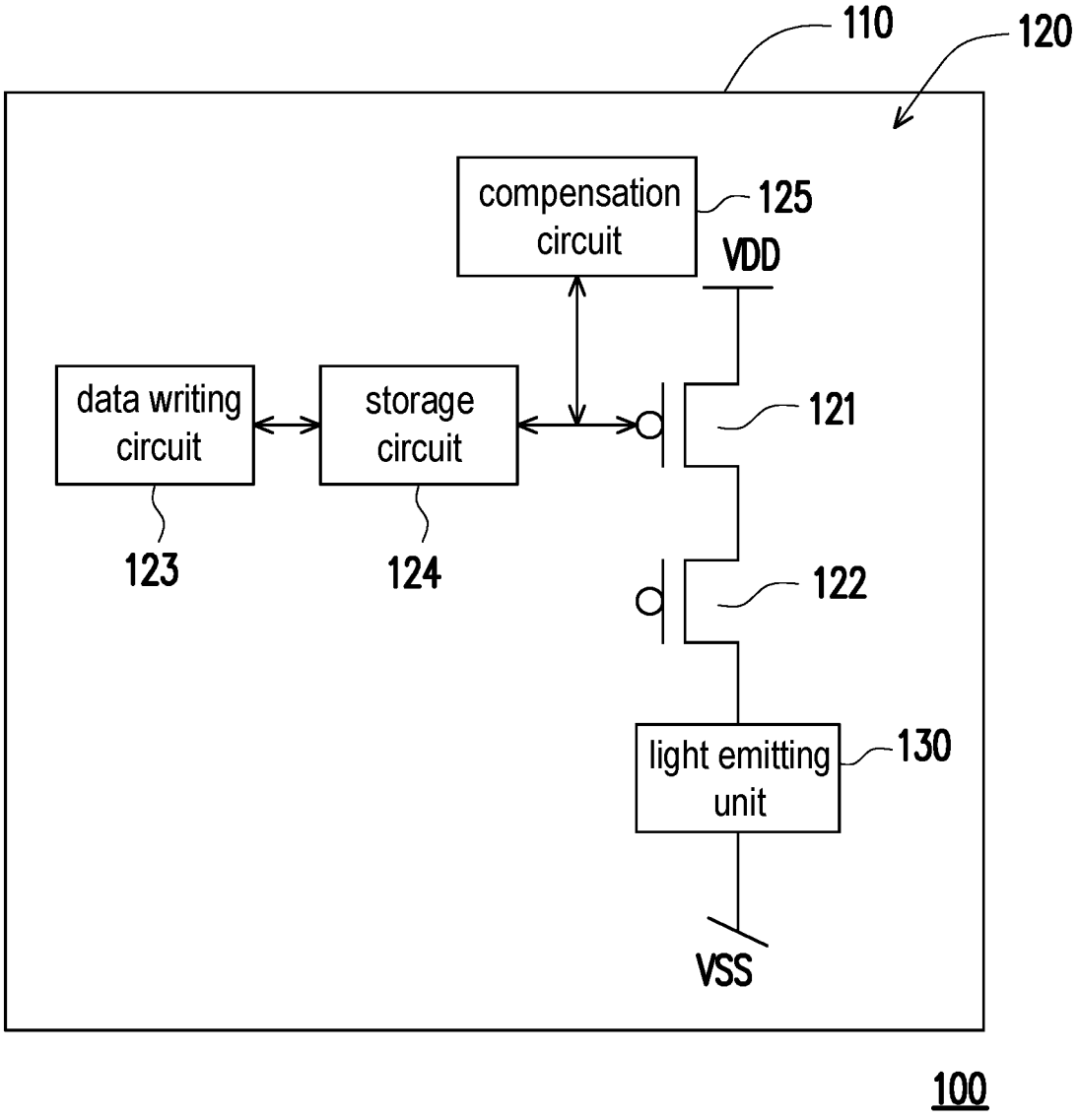
FIG. 1 is a schematic diagram of an electronic device according to an embodiment of the disclosure.

Reference will now be made in detail to exemplary embodiments of the disclosure, examples of which are illustrated in the accompanying drawings. Wherever possible, the same reference numerals are used in the drawings and the description to refer to the same or like parts.

In some embodiments of the disclosure, the term "coupled" can include any direct and indirect electrical connection means. The indirect electrical connection means refers to the situation where there may be other components between the two coupled, and the other components may include circuit components such as capacitors, resistors or inductors, general components or a combination of the foregoing. In some embodiments of the disclosure, the term "coupled between" means that any direct and indirect electrical connection means can be included between two coupled objects. The indirect electrical connection means refers to the situation where there are other components between the two coupled objects, and the other components may include circuit components such as capacitors, resistors or inductors, general components or a combination of the foregoing. In addition, in some embodiments of the disclosure, the term "coupled to a certain voltage" may refer to directly or indirectly coupling to a certain voltage line, a certain voltage terminal, or a certain voltage source, or receiving a certain voltage.

In some embodiments of the disclosure, the term "disposing" can include any direct and indirect means of disposing, configuring or forming. Indirect means of disposing, configuring or forming refers to the situation in which other components, objects or other material layers, etc., may also be disposed, configured or formed between the two.

It should be noted that the following embodiments may combine, modify, replace or adapt features from several different embodiments to complete other embodiments without departing from the spirit of the disclosure. The features of each embodiment can be mixed and matched as long as they do not contradict the spirit of the disclosure or conflict with each other.

The use of ordinal numbers such as "first", "second", "third" and other terms used in the specification and claims to modify the components does not in itself imply and represent that the, or those, components have any previous ordinal numbers, nor does it represent the order of a component and another group of components, or the order of manufacturing methods. The use of these ordinal numbers is only used to enable a named component and another component with the same name can be clearly distinguished. The claims and the specification may not use the same terminology, according to which the first member in the specification may be the second member in the claims.

The electronic device disclosed herein may, for example, include a display device, an antenna device, a sensing device, a touch display, a curved display or a free shape display, and may also be a bendable or flexibly spliced electronic device, but is not limited thereto. The light emitting unit of the electronic device may include, for example, a light-emitting diode (LED), liquid crystal, fluorescence, phosphor, quantum dot (QD), other suitable display medium, or a combination of the foregoing, but is not limited thereto. The light-emitting diode may, for example, include an organic light-emitting diode (OLED), an inorganic light-emitting diode (ILED), a mini LED, a micro LED or a quantum dot light-emitting diode (such as QLED, QDLED), or other suitable materials or any combination of the foregoing, but is not limited thereto. The antenna device may be, for example, a liquid crystal antenna, but is not limited thereto. It should be noted that the electronic device disclosed herein can be any combination of the aforementioned arrangements, but is not limited thereto. In addition, the shape of the electronic device can be rectangular, round, polygonal, with curved edges of the shape or other suitable shape. The electronic device may have peripheral systems such as driving system, control system, light source system, and shelf system to support the display device or antenna device.

Throughout the description and the appended claims, certain terms are used to refer to specific components. Those skilled in the art should understand that electronic devices manufacturers may refer to the same component by different terms. The present specification does not intend to distinguish between components that differ in name but not function. In the following description and the claims, terms such as "include" and "comprise" are open-ended, and therefore should be interpreted as "include but not limited to."

FIG. 1 is a schematic diagram of an electronic device according to an embodiment of the disclosure. Referring to FIG. 1, an electronic device 100 includes a substrate 110, a driving circuit 120 and a light emitting unit 130. The driving circuit 120 and the light emitting unit 130 are disposed on the substrate 110. The driving circuit 120 includes a driving transistor 121, an emitting transistor 122, a data writing circuit 123, a storage circuit 124, and a compensation circuit 125. According to this embodiment, a first end of the driving transistor 121 is coupled to the storage circuit 124 and the compensation circuit 125. A second end of the driving transistor 121 is coupled to an operating voltage VDD. A third end of the driving transistor 121 is coupled to a second end of the emitting transistor 122. A third end of the emitting transistor 122 is coupled to one end of the light emitting unit 130, and a first end of the emitting transistor 122 may receive signal (not shown) to determine whether to light up the light emitting unit 130. Another end of the light emitting unit 130 is coupled to a ground voltage VSS. The storage circuit 124 is also coupled to the data writing circuit 123. According to this embodiment, the operating voltage VDD, the driving transistor 121, the emitting transistor 122, the light emitting unit 130, and the ground voltage VSS form a pixel driving current path. The transistor of the disclosure (such as the driving transistor 121 or the emitting transistor 122) may include semiconductor materials, such as amorphous silicon, low temperature poly silicon (LTPS) or metal oxide (metal oxide). The transistor may be a thin-film transistor including a top gate, a bottom gate, or a dual gate or double gate, or a combination of the foregoing materials, and the disclosure is not limited thereto. According to some embodiments, the thin-film transistor may have the above different semiconductor materials. The first end, second end, and third end of the transistors of the disclosure (such as the driving transistor 121 or the emitting transistor 122) may be a gate, a source, and a drain, respectively, but the disclosure is not limited thereto. In addition, the gate of the transistor can be regarded as a control end of the transistor. Moreover, the gate of the transistor of the disclosure may include polysilicon, metal or other conductive materials, and is not limited thereto. The metals include copper (Cu), aluminum (Al), molybdenum (Mo), tungsten (W), gold (Au), chromium (Cr), nickel (Ni), platinum (Pt) or titanium (Ti), and are not limited thereto. The materials of the source and drain of the transistor of the disclosure may include metals, such as copper (Cu), aluminum (Al), molybdenum (Mo), tungsten (W), gold (Au), chromium (Cr), nickel (Ni)), platinum (Pt) or titanium (Ti), and are not limited thereto.

The substrate 110 of the disclosure may be a rigid substrate or a flexible substrate, and the material of the substrate 110 includes, for example, glass, quartz, ceramic, sapphire, or plastic, etc., but the disclosure is not limited thereto. According to another embodiment, the material of the substrate 110 may include a suitable opaque material. According to some embodiments, when the substrate 110 is a flexible substrate, suitable flexible material may be included, such as polycarbonate (PC), polyimide (PI), polypropylene (PP) or polyethylene terephthalate (PET), other suitable materials, or a combination of the foregoing materials, but is not limited thereto. In addition, light transmittance of the substrate 110 is not limited, that is, the substrate 110 may be a transparent substrate, a translucent substrate, or an opaque substrate.

According to this embodiment, the data writing circuit 123 and the compensation circuit 125 may each include circuit composed of one or more transistors, and the storage circuit 124 may include a capacitor. The data writing circuit 123 may be configured to provide a data signal to the storage circuit 124, and the storage circuit 124 may store the data signal. The storage circuit 124 may provide the data signal to the driving transistor 121, so that the driving transistor 121 may provide a corresponding driving current from the operating voltage VDD to the emitting transistor 122 according to a voltage of the data signal. When the emitting transistor 122 is turned on (or is conducted), the emitting transistor 122 may provide the driving current to the light emitting unit 130. It should be noted that the compensation circuit 125 is also coupled to any node on the pixel driving current path to provide a compensation bias to the first end of the driving transistor 121 according to a voltage of the node. The driving circuit 120 according to this embodiment may be a circuit structure composed of multiple transistors, for example, a circuit structure composed of two transistors and a capacitor (2T1C), or a circuit structure composed of seven transistors and two capacitors (7T2C), or a circuit structure composed of eight transistors and two capacitors (8T2C), and the disclosure is not limited thereto. The following embodiments will be illustrated by a circuit composed of eight transistors, but the disclosure is not limited thereto.

Figure 2:
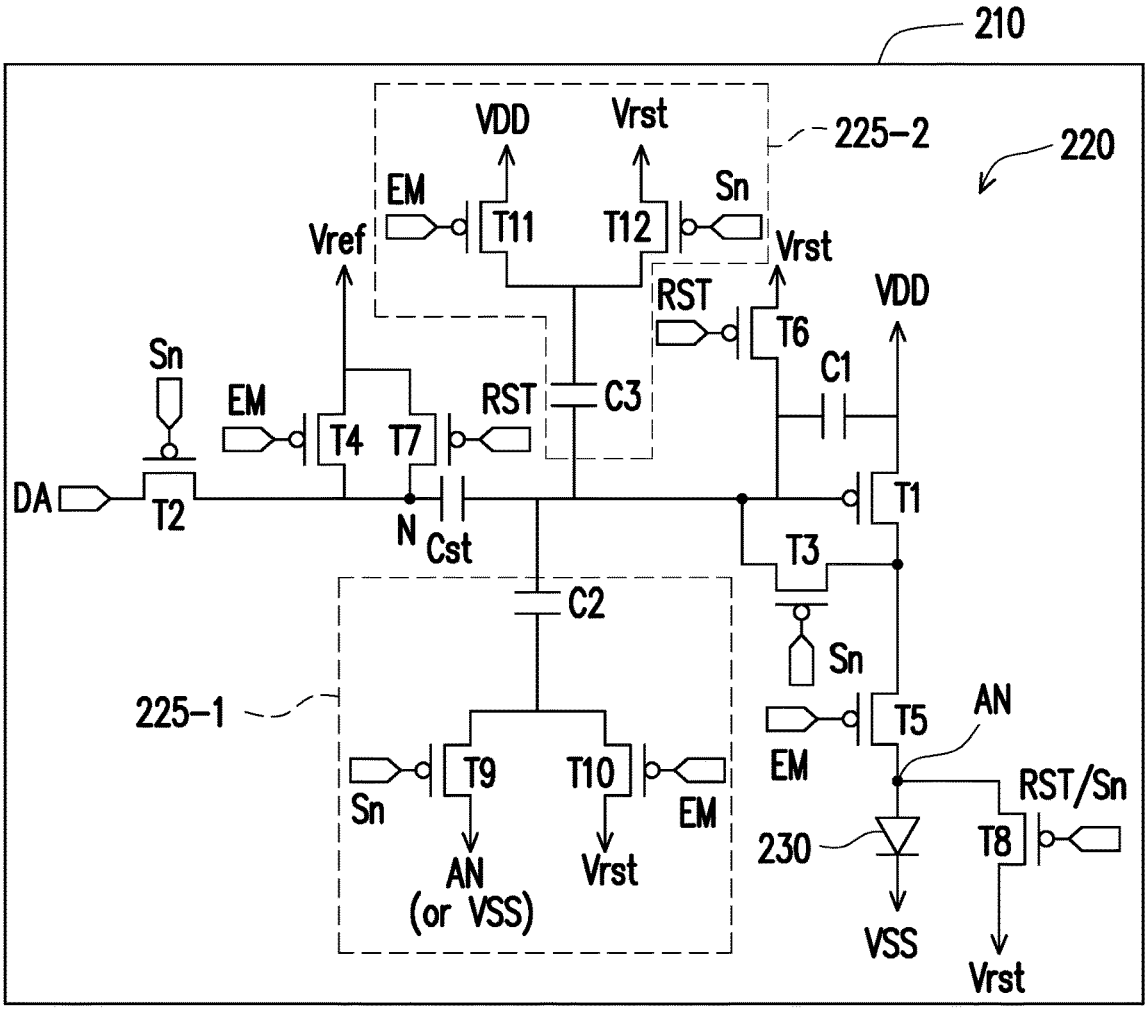
FIG. 2 is a schematic diagram of a driving circuit according to a first embodiment of the disclosure.

FIG. 2 is a schematic diagram of a driving circuit according to a first embodiment of the disclosure. Referring to FIG. 2, an electronic device 200 includes a substrate 210, a driving circuit 220 and a light emitting unit 230. Examples of material of the substrate 210 can be referred to the examples of the material of the substrate 110 and will not be repeated in the following. The driving circuit 220 is disposed on the substrate 210, and the driving circuit 220 includes transistors T1 to T12, capacitors C1 to C3, and a storage capacitor Cst. The transistors T1 to T12 may be P-type transistors, but the disclosure is not limited thereto. According to an embodiment, the transistors T1 to T12 may also be designed as N-type transistors. Or, a part of the transistors T1 to T12 are P-type transistors, and an other part of the transistors T1 to T12 are N-type transistors. In addition, it should be understood that some components will be omitted and/or simplified in FIG. 2 for better understanding.

According to this embodiment, the transistor T1 may be a driving transistor, and may correspond to the driving transistor 121 as shown in FIG. 1, and the transistor T11 may be a compensation transistor. A first end of the transistor T1 (e.g., a gate G) is coupled to one end of the storage capacitor Cst, and an other end of the storage capacitor Cst is coupled to a third end of the transistor T2 and a third end of the transistor T4 through a node N. The transistor T2 may be a switch transistor, and may correspond to the data writing circuit 123 as shown in FIG. 1. A first end of the transistor T2 receives a writing signal Sn, and a second end of the transistor T2 receives a data signal DA. A first end of the transistor T4 may receive an emitting signal EM. A second end of the transistor T4 is coupled to a reference voltage Vref. A second end of the transistor T1 is coupled to the operating voltage VDD, and the capacitor C1 is coupled between the first end and the second end (for example, a source S) of the transistor T1. A third end (for example, a drain D) of the transistor T1 is coupled to a second end of the transistor T5. The transistor T5 may be an emitting transistor, and may correspond to the emitting transistor 122 as shown in FIG. 1. A first end of the transistor T5 may receive the emitting signal EM. A third end of the transistor T5 is coupled to an anode AN of the light emitting unit 230. A cathode of the light emitting unit 230 is coupled to the ground voltage VSS. The light emitting unit 230 may correspond to the light emitting unit 130 as shown in FIG. 1. In addition, it should be noted that the transistors T5, T10, and T11 according to this embodiment may receive same signal, for example, the emitting signal EM, but the disclosure is not limited thereto. In more detail, a first end of the transistor T11 and the first end of the transistor T5 may receive same emitting signal EM. Similarly, a first end of the transistor T10 and the first end of the transistor T5 may receive the same emitting signal EM.

According to this embodiment, the operating voltage VDD, the transistor T1, the transistor T5, the light emitting unit 230, and the ground voltage VSS form the pixel driving current path. When the transistor T2 is turned on, the data signal DA may be written from the transistor T2 to the storage capacitor Cst. The capacitor Cst may provide a corresponding voltage to the transistor T1, so that the transistor T1 operates in a saturation region, and provides a corresponding driving current from the operating voltage VDD to the transistor T5. When the transistor T5 is turned on, the light emitting unit 230 may be driven by the driving current provided by the transistor T5.

According to this embodiment, the transistor T3 may be a compensation transistor. A first end of the transistor T3 receives the writing signal Sn, and a second end of the transistor T3 and a third end of the transistor T3 are coupled to the first end of the transistor T1 and a third end of the transistor T1. The transistor T3 may compensate a voltage of the first end of the transistor T1.

According to this embodiment, the transistor T6 may be a reset transistor. A first end of the transistor T6 may receive a reset signal RST. A second end of the transistor T6 is coupled to a reset voltage Vrst. A third end of the transistor T6 is coupled to the capacitor C1 and the first end of the transistor T1. According to this embodiment, the transistor T6 may be configured to reset potential of the first end of the transistor T1.

According to this embodiment, the transistor T7 may be a reset transistor. A first end of the transistor T7 may receive the reset signal RST. A second end of the transistor T7 is coupled to the reference voltage Vref. A third end of the transistor T7 is coupled to the node N. The transistor T7 may be configured to reset potential of the node N (i.e., potential of one end of the storage capacitor Cst). According to an embodiment, a voltage of the reference voltage Vref may be lower than a voltage of the ground voltage VSS, but the disclosure is not limited thereto. In addition, the reference voltage Vref and the reset voltage Vrst are independent voltages. In other words, the reference voltage Vref and the reset voltage Vrst may be individually given different voltage values according to design requirements, and the voltage values of each other are not interfered with. According to an embodiment, the voltage of the reference voltage Vref may be equal to a voltage of the reset voltage Vrst, but the disclosure is not limited thereto. According to another embodiment, the reference voltage Vref and the reset voltage Vrst may be dependent voltages, that is, the voltage values of the reference voltage Vref and the reset voltage Vrst will affect each other, and the disclosure is not limited thereto.

According to this embodiment, the transistor T8 may be a reset transistor. A first end of the transistor T8 may receive the reset signal RST or the writing signal Sn. A second end of the transistor T8 is coupled to the anode AN of the light emitting unit 230. A third end of the transistor T8 is coupled to the reset voltage Vrst. According to this embodiment, the transistor T8 may be configured to reset potential of the anode AN of the light emitting unit 230.

According to this embodiment, the transistors T9, T10 and the capacitor C2 constitute a compensation circuit 225-1. The transistor T9 may be a compensation transistor. The transistor T10 may be a reset transistor. One end of the capacitor C2 is coupled to the first end of the transistor T1, and an other end of the capacitor C2 is coupled to a second end of the transistor T9 and a second end of the transistor T10. A first end of the transistor T9 may receive the writing signal Sn. A third end of the transistor T9 is coupled to the anode AN of the light emitting unit 230 or the ground voltage VSS. The first end of the transistor T10 may receive the emitting signal EM. A third end of the transistor T10 is coupled to the reset voltage Vrst. According to this embodiment, the compensation circuit 225-1 may compensate the transistor T1 according to a voltage of the anode AN of the light emitting unit 230 or the ground voltage VSS.

According to this embodiment, the transistors T11, T12 and the capacitor C3 constitute a compensation circuit 225-2. According to some embodiments, the transistor T12 may be a reset transistor. One end of the capacitor C3 is coupled to the first end of the transistor T1, and an other end of the capacitor C3 is coupled to a third end of the transistor T11 and a third end of the transistor T12. The first end of the transistor T11 may receive the emitting signal EM. A second end of the transistor T11 is coupled to the operating voltage VDD. A first end of the transistor T12 may receive the writing signal Sn. The third end of the transistor T12 is coupled to the reset voltage Vrst. According to this embodiment, the compensation circuit 225-2 may compensate the transistor T1 according to the operating voltage VDD.

Figure 3:
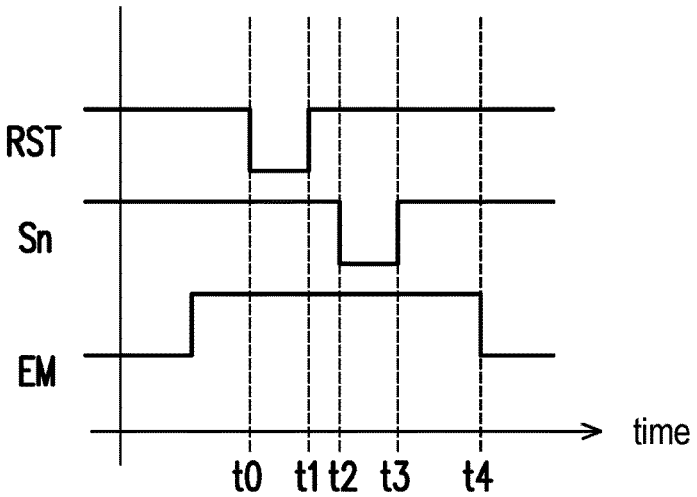
FIG. 3 is a diagram of signal sequence according to an embodiment of the disclosure.

FIG. 3 is a diagram of signal sequence according to an embodiment of the disclosure. Referring to FIG. 2 and FIG. 3, the signal sequence of FIG. 3 may be applied to the driving circuit 220 of FIG. 2. With reference to the following Table 1, according to this embodiment, the reset signal RST and the writing signal Sn (for example, P-type transistor is taken as an example) are at high voltage potential before a time t0. During a reset period from the time t0 to a time t1, the reset signal RST is switched to low voltage potential, and the writing signal Sn and the emitting signal EM are maintained at high voltage potential. Therefore, when the first end of the transistor T8 receives the reset signal RST, the transistors T1, T6, T7, and T8 are turned on, and the transistors T2 to T5 and T9 to T12 are turned off (or are not conducted). When the first end of the transistor T8 receives the writing signal Sn, the transistors T1, T6, and T7 are turned on, and the transistors T2 to T5 and T8 to T12 are turned off. During the reset period, a voltage of the node N is reset according to the reference voltage Vref, and the reference voltage Vref is reset according to the reset voltage Vrst. In this regard, during the reset period, the voltage of the node N is the reference voltage Vref. The voltage of the first end of the transistor T1 is similar to the reset voltage Vrst. A voltage of the second end of the transistor T1 is the operating voltage VDD. A voltage of the third end of the transistor T1 is the operating voltage VDD. It should be noted that FIG. 3 shows P-type transistor as an example, but the disclosure is not limited thereto.

During a period from the time t1 to a time t2, the reset signal RST returns to high voltage potential, and the writing signal Sn and the emitting signal EM are high voltage potential. During a compensation period from the time t2 to a time t3, the writing signal Sn is switched to low voltage potential, and the reset signal RST and the emitting signal EM are maintained at high voltage potential. Therefore, when the first end of the transistor T8 receives the reset signal RST, the transistors T1 to T3, T9, and T12 are turned on, and the transistors T4 to T8, T10, and T11 are turned off. When the first end of the transistor T8 receives the writing signal Sn, the transistors T1 to T3, T8, T9, and T12 are turned on, and the transistors T4 to T7, T10, and T11 are turned off. During the compensation period, the data signal DA is written into the storage capacitor Cst, and the transistor T3 compensates the first end of the transistor T1 according to the operating voltage VDD. In this regard, during the compensation period, the voltage of the node N is "Vda", where "Vda" is a voltage of the data signal DA. The voltage of the first end of the transistor T1 is "VDD−|Vth|", where "|Vth|" is a threshold voltage of the transistor T1. The voltage of the second end of the transistor T1 is the operating voltage VDD. The voltage of the third end of the transistor T1 is "VDD−Vx", where "Vx" is a constant voltage value and may be used to offset voltage influence caused by one or more transistor effects, including, for example, voltage influence caused by kink effect.

During a period from the time t3 to a time t4, the writing signal Sn returns to high voltage potential, and the reset signal RST and the emitting signal EM are high voltage potential. During an emitting period after the time t4, the emitting signal EM is switched to low voltage level, and the writing signal Sn and the reset signal RST are maintained at high voltage level. Therefore, the transistors T1, T4, T5, T10, and T11 are turned on, and the transistors T2, T3, T6 to T9, and T12 are turned off. During the emitting period, the storage capacitor Cst and the capacitor C1 provide corresponding voltages to the first end of the transistor T1 to enable the transistor T1 to drive the light emitting unit 230 using a corresponding driving current provided by the operating voltage VDD. In this regard, during the emitting period, the voltage of the node N is the reference voltage Vref. The voltage of the first end of the transistor T1 is "(Vrst−Van)+(VDD−Vrst)+VDD−|Vth|+(Vref−Vda)", where "Van" is a voltage of the cathode of the light emitting unit 230. The voltage of the second end of the transistor T1 is the operating voltage VDD. The voltage of the third end of the transistor T1 is "Van−VDD+Vx". Finally, a voltage difference between the second end of the transistor T1 and the first end of the transistor T1 plus a voltage of a compensation result Vsg+Vth of the threshold voltage of the transistor T1 may be "Vx+(Vda−Vref)". Accordingly, non-ideal bias, or the influence of the kink effect, or influence of voltage deviation of the operating voltage VDD and the ground voltage VSS may be reduced in the voltage of the compensation result Vsg+Vth.

TABLE 1

| | node N | first end | second end | third side | Vsg + Vth |
|---|---|---|---|---|---|
| reset period | Vref | Vrst | VDD | VDD | — |
| compensation period | Vda | VDD − \|Vth\| | VDD | VDD − Vx | — |
| emitting period | Vref | (Vrst − Van) + (VDD − Vrst) + VDD − \|Vth\| + (Vref − Vda) | VDD | Van − VDD + Vx | Vx + (Vda − Vref) |

Figure 4:
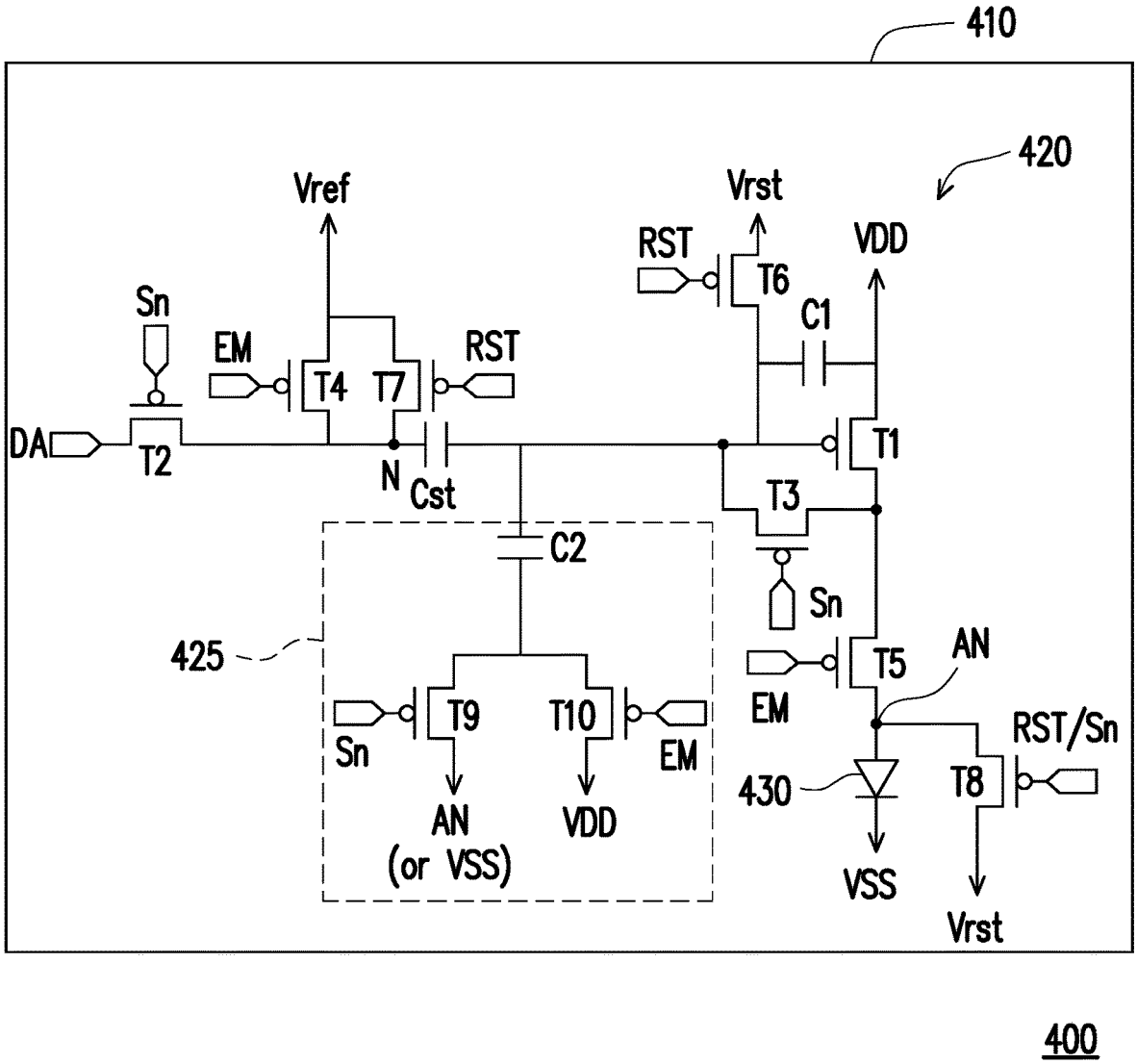
FIG. 4 is a schematic diagram of a driving circuit according to a second embodiment of the disclosure.

FIG. 4 is a schematic diagram of a driving circuit according to a second embodiment of the disclosure. Referring to FIG. 4, an electronic device 400 includes a substrate 410, a driving circuit 420, and a light emitting unit 430. Examples of material of the substrate 410 can be referred to the examples of the material of the substrate 110 and will not be repeated in the following. The driving circuit 420 is disposed on the substrate 410, and the driving circuit 420 includes transistors T1 to T10, capacitors C1 to C2, and a storage capacitor Cst. According to this embodiment, circuit coupling relationship between the transistors T1 to T8 and the storage capacitor Cst is as described according to the embodiment of FIG. 2, and can be referred to the description according to the embodiment of FIG. 2 and will not be repeated in the following. In addition, it should be noted that the transistors T5 and T10 according to this embodiment may receive same signal, for example, the emitting signal EM. In more detail, a first end of the transistor T10 and the first end of the transistor T5 may receive the same emitting signal EM, but this disclosure is not limited thereto. Moreover, according to some embodiments, the transistor T10 may be a compensation transistor. It should be understood that some components will be omitted and/or simplified in FIG. 4 for better understanding.

According to this embodiment, the transistors T9, T10 and the capacitor C2 constitute a compensation circuit 425. One end of the capacitor C2 is coupled to the first end of the transistor T1, and an other end of the capacitor C2 is coupled to the second end of the transistor T9 and the second end of the transistor T10. The first end of the transistor T9 may receive the writing signal Sn. The third end of the transistor T9 is coupled to an anode AN of the light emitting unit 430 or receives the ground voltage VSS. The first end of the transistor T10 may receive the emitting signal EM. The third end of the transistor T10 may receive the operating voltage VDD. According to this embodiment, the compensation circuit 425 may compensate the transistor T1 according to the operating voltage VDD and a voltage of the anode AN of the light emitting unit 430 or the ground voltage VSS.

Referring to FIG. 4 and FIG. 3, the signal sequence of FIG. 3 may also be applied to the driving circuit 420 of FIG. 4. With reference to the following Table 2, according to this embodiment, the reset signal RST and the writing signal Sn (for example, P-type transistor is taken as an example) are at high voltage potential before a time to. During a reset period from the time t0 to a time t1, the reset signal RST is switched to low voltage potential, and the writing signal Sn and the emitting signal EM are maintained at high voltage potential. Therefore, when the first end of the transistor T8 receives the reset signal RST, the transistors T1, T6, T7, and T8 are turned on, and the transistors T2 to T5, T9 and T10 are turned off (or are not conducted). When the first end of the transistor T8 receives the writing signal Sn, the transistors T1, T6, and T7 are turned on, and the transistors T2 to T5 and T8 to T12 are turned off. During the reset period, a voltage of the node N is reset according to the reference voltage Vref, and the reference voltage Vref is reset according to the reset voltage Vrst. In this regard, during the reset period, the voltage of the node N is the reference voltage Vref. The voltage of the first end of the transistor T1 is the reset voltage Vrst. A voltage of the second end of the transistor T1 is the operating voltage VDD. A voltage of the third end of the transistor T1 is the operating voltage VDD.

During a period from the time t1 to a time t2, the reset signal RST returns to high voltage potential, and the writing signal Sn and the emitting signal EM are high voltage potential. During a compensation period from the time t2 to a time t3, the writing signal Sn is switched to low voltage potential, and the reset signal RST and the emitting signal EM are maintained at high voltage potential. Therefore, when the first end of the transistor T8 receives the reset signal RST, the transistors T1 to T3 and T9 are turned on, and the transistors T4 to T8 and T10 are turned off. When the first end of the transistor T8 receives the writing signal Sn, the transistors T1 to T3 and T8 to T9 are turned on, and the transistors T4 to T7 and T10 are turned off. During the compensation period, the data signal DA is written into the storage capacitor Cst, and the transistor T3 compensates the first end of the transistor T1 according to the operating voltage VDD. In this regard, during the compensation period, the voltage of the node N is "Vda". The voltage of the first end of the transistor T1 is "VDD−|Vth|". The voltage of the second end of the transistor T1 is the operating voltage VDD. The voltage of the third end of the transistor T1 is "VDD−Vx".

During a period from the time t3 to a time t4, the writing signal Sn returns to high voltage potential, and the reset signal RST and the emitting signal EM are high voltage potential. During an emitting period after the time t4, the emitting signal EM is switched to low voltage level, and the writing signal Sn and the reset signal RST are maintained at high voltage level. Therefore, the transistors T1, T4, T5 and T10 are turned on, and the transistors T2, T3 and T6 to T9 are turned off. During the emitting period, the storage capacitor Cst and the capacitor C1 provide corresponding voltages to the first end of the transistor T1 to enable the transistor T1 to drive the light emitting unit 430 using a corresponding driving current provided by the operating voltage VDD. In this regard, during the emitting period, the voltage of the node N is the reference voltage Vref. The voltage of the first end of the transistor T1 is "(VDD−Van)+VDD−|Vth|+(Vref−Vda)". The voltage of the second end of the transistor T1 is the operating voltage VDD. The voltage of the third end of the transistor T1 is "Van−VDD+Vx". Finally, a voltage difference between the second end of the transistor T1 and the first end of the transistor T1 plus a voltage of a compensation result Vsg+Vth of the threshold voltage of the transistor T1 may be "Vx+(Vda−Vref)". Accordingly, non-ideal bias, or the influence of the kink effect, or influence of voltage deviation of the operating voltage VDD and the ground voltage VSS may be reduced in the voltage of the compensation result Vsg+Vth.

TABLE 2

| | node N | first end | second end | third side | Vsg + Vth |
|---|---|---|---|---|---|
| reset period | Vref | Vrst | VDD | VDD | — |
| compensation period | Vda | VDD − \|Vth\| | VDD | VDD − Vx | — |
| emitting period | Vref | (VDD − Van) + VDD − \|Vth\| + (Vref − Vda) | VDD | Van − VDD + Vx | Vx + (Vda − Vref) |

Figure 5:
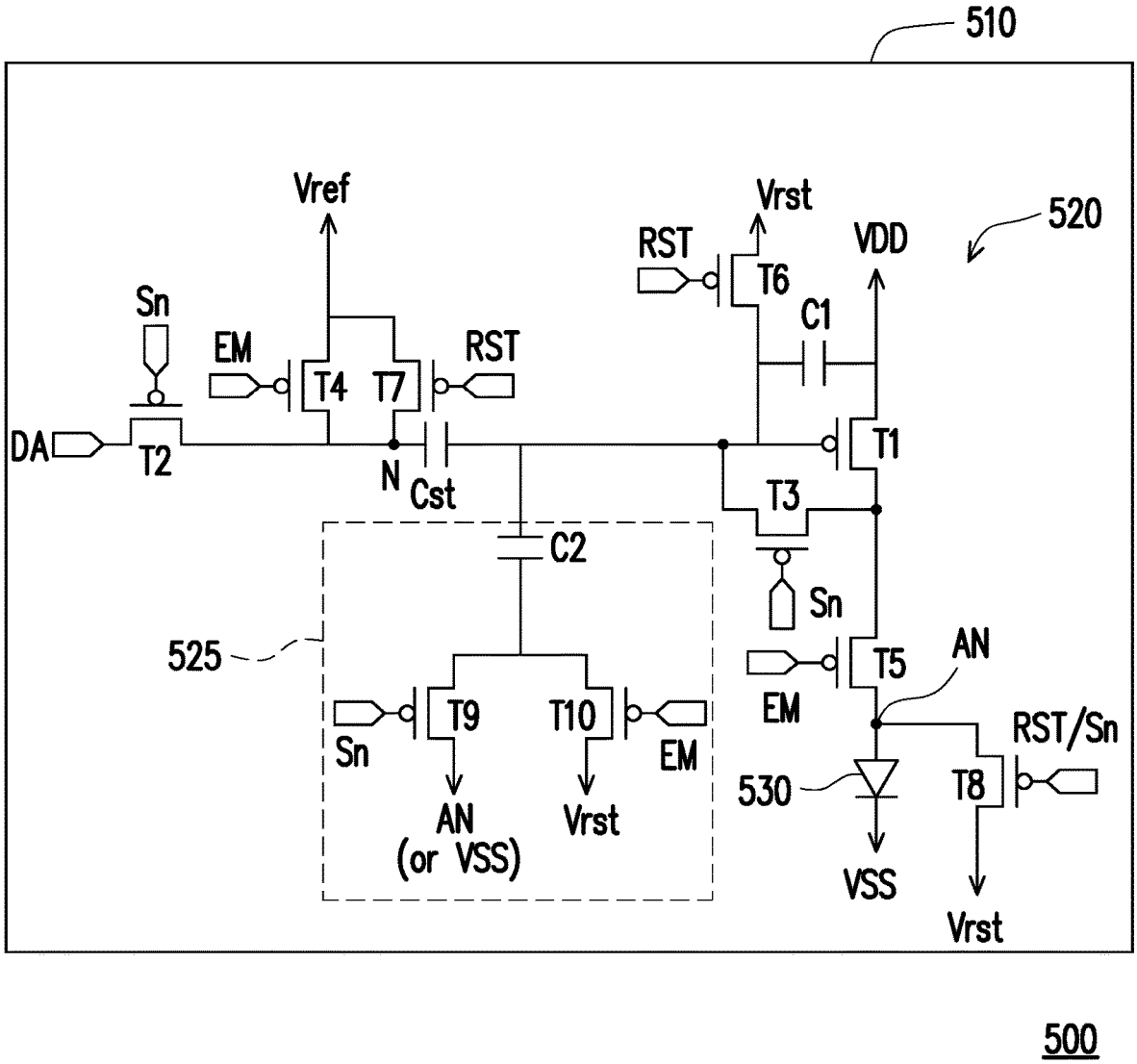
FIG. 5 is a schematic diagram of a driving circuit according to a third embodiment of the disclosure.

FIG. 5 is a schematic diagram of a driving circuit according to a third embodiment of the disclosure. Referring to FIG. 5, an electronic device 500 includes a substrate 510, a driving circuit 520, and a light emitting unit 530. Examples of material of the substrate 510 can be referred to the examples of the material of the substrate 110 and will not be repeated in the following. The driving circuit 520 is disposed on the substrate 510, and the driving circuit 520 includes transistors T1 to T10, capacitors C1 to C2, and a storage capacitor Cst. According to this embodiment, circuit coupling relationship between the transistors T1 to T8, the capacitor C1, and the storage capacitor Cst is as described according to the embodiment of FIG. 2, and can be referred to the description according to the embodiment of FIG. 2 and will not be repeated in the following. In addition, it should be noted that the transistors T4, T5, and T10 according to this embodiment may receive same signal, for example, the emitting signal EM. In more detail, the first end of the transistor T10, the first end of the transistor T5, and the first end of the transistor T4 may receive the same emitting signal EM, but the disclosure is not limited thereto. In addition, according to some embodiments, the transistor T10 may be a compensation transistor. It should be understood that some components will be omitted and/or simplified in FIG. 5 for better understanding.

According to this embodiment, the transistors T9, T10 and the capacitor C2 constitute a compensation circuit 525. One end of the capacitor C2 is coupled to the first end of the transistor T1, and an other end of the capacitor C2 is coupled to the second end of the transistor T9 and the second end of the transistor T10. The first end of the transistor T9 may receive the writing signal Sn. The third end of the transistor T9 is coupled to an anode AN of the light emitting unit 530 or the ground voltage VSS. The first end of the transistor T10 may receive the emitting signal EM. The third end of the transistor T10 is coupled to the reset voltage Vrst. According to this embodiment, the compensation circuit 525 may compensate the transistor T1 according to a voltage of the anode AN of the light emitting unit 530 or the ground voltage VSS.

Referring to FIG. 5 and FIG. 3, the signal sequence of FIG. 3 may also be applied to the driving circuit 520 of FIG. 5. With reference to the following Table 3, according to this embodiment, the reset signal RST and the writing signal Sn (for example, P-type transistor is taken as an example) are at high voltage potential before a time to. During a reset period from the time t0 to a time t1, the reset signal RST is switched to low voltage potential, and the writing signal Sn and the emitting signal EM are maintained at high voltage potential. Therefore, when the first end of the transistor T8 receives the reset signal RST, the transistors T1, T6, T7, and T8 are turned on, and the transistors T2 to T5, T9 and T10 are turned off (or are not conducted). When the first end of the transistor T8 receives the writing signal Sn, the transistors T1, T6, and T7 are turned on, and the transistors T2 to T5, T8, T9 and T10 are turned off. During the reset period, a voltage of the node N is reset according to the reference voltage Vref, and the reference voltage Vref is reset according to the reset voltage Vrst. In this regard, during the reset period, the voltage of the node N is the reference voltage Vref. The voltage of the first end of the transistor T1 is the reset voltage Vrst. A voltage of the second end of the transistor T1 is the operating voltage VDD. A voltage of the third end of the transistor T1 is the operating voltage VDD.

During a period from the time t1 to a time t2, the reset signal RST returns to high voltage potential, and the writing signal Sn and the emitting signal EM are high voltage potential. During a compensation period from the time t2 to a time t3, the writing signal Sn is switched to low voltage potential, and the reset signal RST and the emitting signal EM are maintained at high voltage potential. Therefore, when the first end of the transistor T8 receives the reset signal RST, the transistors T1 to T3 and T9 are turned on, and the transistors T4 to T8 and T10 are turned off. When the first end of the transistor T8 receives the writing signal Sn, the transistors T1 to T3, T8 and T9 are turned on, and the transistors T4 to T7 and T10 are turned off. During the compensation period, the data signal DA is written into the storage capacitor Cst, and the transistor T3 compensates the first end of the transistor T1 according to the operating voltage VDD. In this regard, during the compensation period, the voltage of the node N is "Vda". The voltage of the first end of the transistor T1 is "VDD−|Vth|". The voltage of the second end of the transistor T1 is the operating voltage VDD. The voltage of the third end of the transistor T1 is "VDD−Vx".

During a period from the time t3 to a time t4, the writing signal Sn returns to high voltage potential, and the reset signal RST and the emitting signal EM are high voltage potential. During an emitting period after the time t4, the emitting signal EM is switched to low voltage level, and the writing signal Sn and the reset signal RST are maintained at high voltage level. Therefore, the transistors T1, T4, T5 and T10 are turned on, and the transistors T2, T3 and T6 to T9 are turned off. During the emitting period, the storage capacitor Cst and the capacitor C1 provide corresponding voltages to the first end of the transistor T1 to enable the transistor T1 to drive the light emitting unit 530 using a corresponding driving current provided by the operating voltage VDD. In this regard, during the emitting period, the voltage of the node N is the reference voltage Vref. The voltage of the first end of the transistor T1 is "(Vrst−Van)+VDD−|Vth|+(Vref−Vda)". The voltage of the second end of the transistor T1 is the operating voltage VDD. The voltage of the third end of the transistor T1 is "Van−VDD+Vx". Finally, a voltage difference between the second end of the transistor T1 and the first end of the transistor T1 plus a voltage of a compensation result Vsg+Vth of the threshold voltage of the transistor T1 may be "VDD−Vrst+(Vda−Vref)+Vx". Accordingly, non-ideal bias, or the influence of the kink effect, or influence of voltage deviation of the operating voltage VDD and the ground voltage VSS may be reduced in the voltage of the compensation result Vsg+Vth.

TABLE 3

| | node N | first end | second end | third side | Vsg + Vth |
|---|---|---|---|---|---|
| reset period | Vref | Vrst | VDD | VDD | — |
| compensation period | Vda | VDD − \|Vth\| | VDD | VDD − Vx | — |
| emitting period | Vref | (Vrst − Van) + VDD − \|Vth\| + (Vref − Vda) | VDD | Van − VDD + Vx | VDD − Vrst + (Vda − Vref) + Vx |

Figure 6:
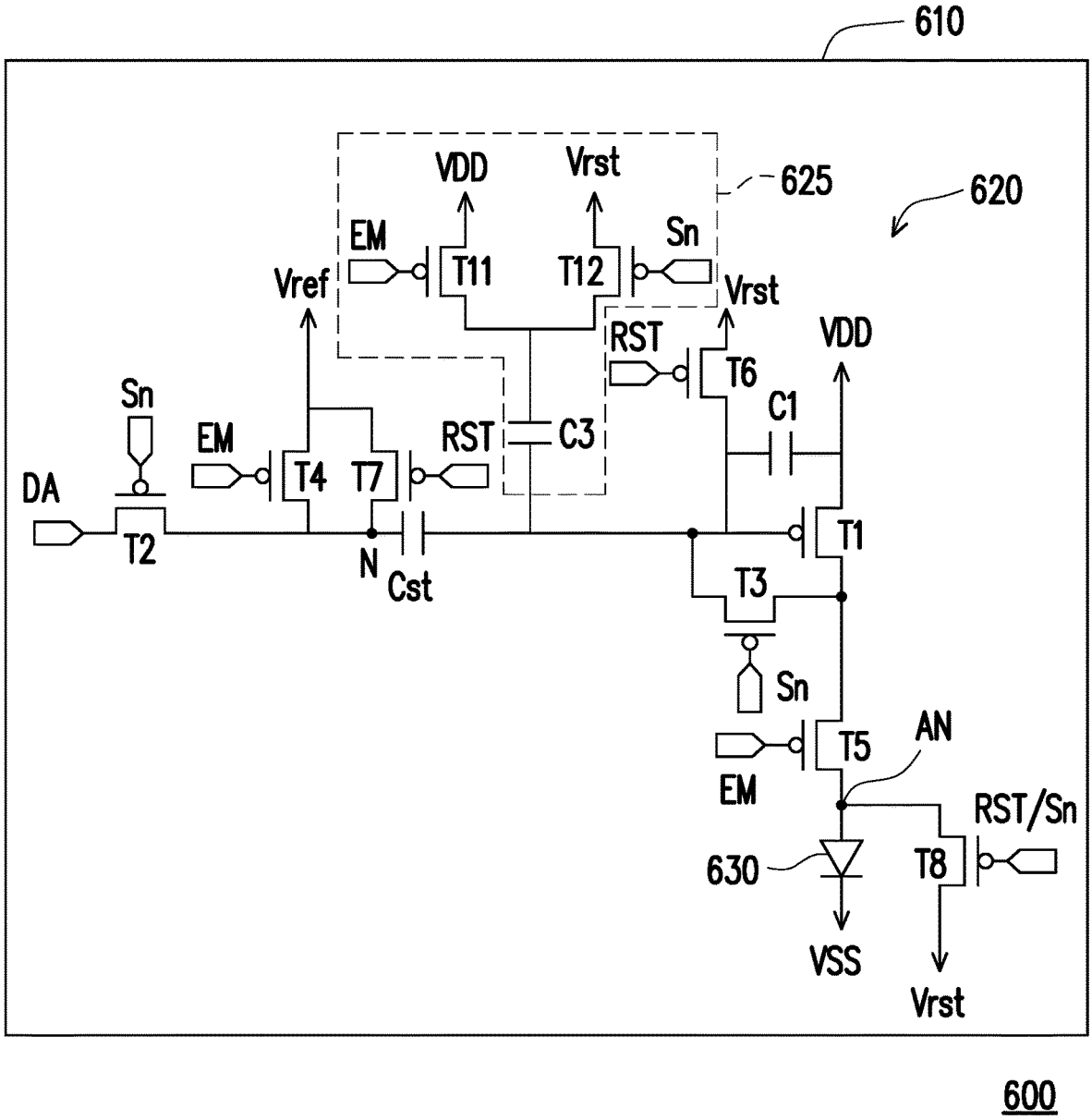
FIG. 6 is a schematic diagram of a driving circuit according to a fourth embodiment of the disclosure.

FIG. 6 is a schematic diagram of a driving circuit according to a fourth embodiment of the disclosure. Referring to FIG. 6, an electronic device 600 includes a substrate 610, a driving circuit 620, and a light emitting unit 630. Examples of material of the substrate 610 can be referred to the examples of the material of the substrate 110 and will not be repeated in the following. The driving circuit 620 is disposed on the substrate 610, and the driving circuit 620 includes transistors T1 to T8, T11, T12, capacitors C1, C3, and a storage capacitor Cst. According to this embodiment, circuit coupling relationship between the transistors T1 to T8, the capacitor C1, and the storage capacitor Cst is as described according to the embodiment of FIG. 2, and can be referred to the description according to the embodiment of FIG. 2 and will not be repeated in the following. In addition, it should be noted that the transistors T5 and T11 according to this embodiment may receive same signal, for example, the emitting signal EM. In more detail, the first end of the transistor T11 and the first end of the transistor T5 may receive the same emitting signal EM, but this disclosure is not limited thereto. In addition, it should be understood that, according to some embodiments, the transistor T11 may be a compensation transistor. Some components will be omitted and/or simplified in FIG. 6 for better understanding.

According to this embodiment, the transistors T11, T12 and the capacitor C3 constitute a compensation circuit 625. One end of the capacitor C3 is coupled to the first end of the transistor T1, and an other end of the capacitor C3 is coupled to the third end of the transistor T11 and the third end of the transistor T12. The first end of the transistor T11 may receive the emitting signal EM. The second end of the transistor T11 is coupled to the operating voltage VDD. The first end of the transistor T12 may receive the writing signal Sn. A second end of the transistor T12 is coupled to the reset voltage Vrst. According to this embodiment, the compensation circuit 625 may compensate the transistor T1 according to the operating voltage VDD.

Referring to FIG. 6 and FIG. 3, the signal sequence of FIG. 3 may also be applied to the driving circuit 620 of FIG. 6. With reference to the following Table 4, according to this embodiment, the reset signal RST and the writing signal Sn (for example, P-type transistor is taken as an example) are at high voltage potential before a time to. During a reset period from the time t0 to a time t1, the reset signal RST is switched to low voltage potential, and the writing signal Sn and the emitting signal EM are maintained at high voltage potential. Therefore, when the first end of the transistor T8 receives the reset signal RST, the transistors T1, T6, T7, and T8 are turned on, and the transistors T2 to T5, T11 and T12 are turned off (or are not conducted). When the first end of the transistor T8 receives the writing signal Sn, the transistors T1, T6, and T7 are turned on, and the transistors T2 to T5, T11 and T12 are turned off. During the reset period, a voltage of the node N is reset according to the reference voltage Vref, and the reference voltage Vref is reset according to the reset voltage Vrst. In this regard, during the reset period, the voltage of the node N is the reference voltage Vref. The voltage of the first end of the transistor T1 is the reset voltage Vrst. A voltage of the second end of the transistor T1 is the operating voltage VDD. A voltage of the third end of the transistor T1 is the operating voltage VDD.

During a period from the time t1 to a time t2, the reset signal RST returns to high voltage potential, and the writing signal Sn and the emitting signal EM are high voltage potential. During a compensation period from the time t2 to a time t3, the writing signal Sn is switched to low voltage potential, and the reset signal RST and the emitting signal EM are maintained at high voltage potential. Therefore, when the first end of the transistor T8 receives the reset signal RST, the transistors T1 to T3 and T12 are turned on, and the transistors T4 to T8 and T11 are turned off. When the first end of the transistor T8 receives the writing signal Sn, the transistors T1 to T3, T8 and T12 are turned on, and the transistors T4 to T7 and T11 are turned off. During the compensation period, the data signal DA is written into the storage capacitor Cst, and the transistor T3 compensates the first end of the transistor T1 according to the operating voltage VDD. In this regard, during the compensation period, the voltage of the node N is "Vda". The voltage of the first end of the transistor T1 is "VDD−|Vth|". The voltage of the second end of the transistor T1 is the operating voltage VDD. The voltage of the third end of the transistor T1 is "VDD−Vx".

During a period from the time t3 to a time t4, the writing signal Sn returns to high voltage potential, and the reset signal RST and the emitting signal EM are high voltage potential. During an emitting period after the time t4, the emitting signal EM is switched to low voltage level, and the writing signal Sn and the reset signal RST are maintained at high voltage level. Therefore, the transistors T1, T4, T5 and T10 are turned on, and the transistors T2, T3 and T6 to T9 are turned off. During the emitting period, the storage capacitor Cst and the capacitor C1 provide corresponding voltages to the first end of the transistor T1 to enable the transistor T1 to drive the light emitting unit 630 using a corresponding driving current provided by the operating voltage VDD. In this regard, during the emitting period, the voltage of the node N is the reference voltage Vref. The voltage of the first end of the transistor T1 is "(VDD−Vrst)+VDD−|Vth|+(Vref−Vda)". The voltage of the second end of the transistor T1 is the operating voltage VDD. The voltage of the third end of the transistor T1 is "Van−VDD+Vx". Finally, a voltage difference between the second end of the transistor T1 and the first end of the transistor T1 plus a voltage of a compensation result Vsg+Vth of the threshold voltage of the transistor T1 may be "Vrst+(Vda−Vref)+Van+Vx". Accordingly, non-ideal bias, or the influence of the kink effect, or influence of voltage deviation of the operating voltage VDD and the ground voltage VSS may be reduced in the voltage of the compensation result Vsg+Vth.

TABLE 4

| | node N | first end | second end | third side | Vsg + Vth |
|---|---|---|---|---|---|
| reset period | Vref | Vrst | VDD | VDD | — |
| compensation period | Vda | VDD − \|Vth\| | VDD | VDD − Vx | — |
| emitting period | Vref | (VDD − Vrst) + VDD − \|Vth\| + (Vref − Vda) | VDD | Van − VDD + Vx | Vrst + (Vda − Vref) + Vx |

Figure 7:
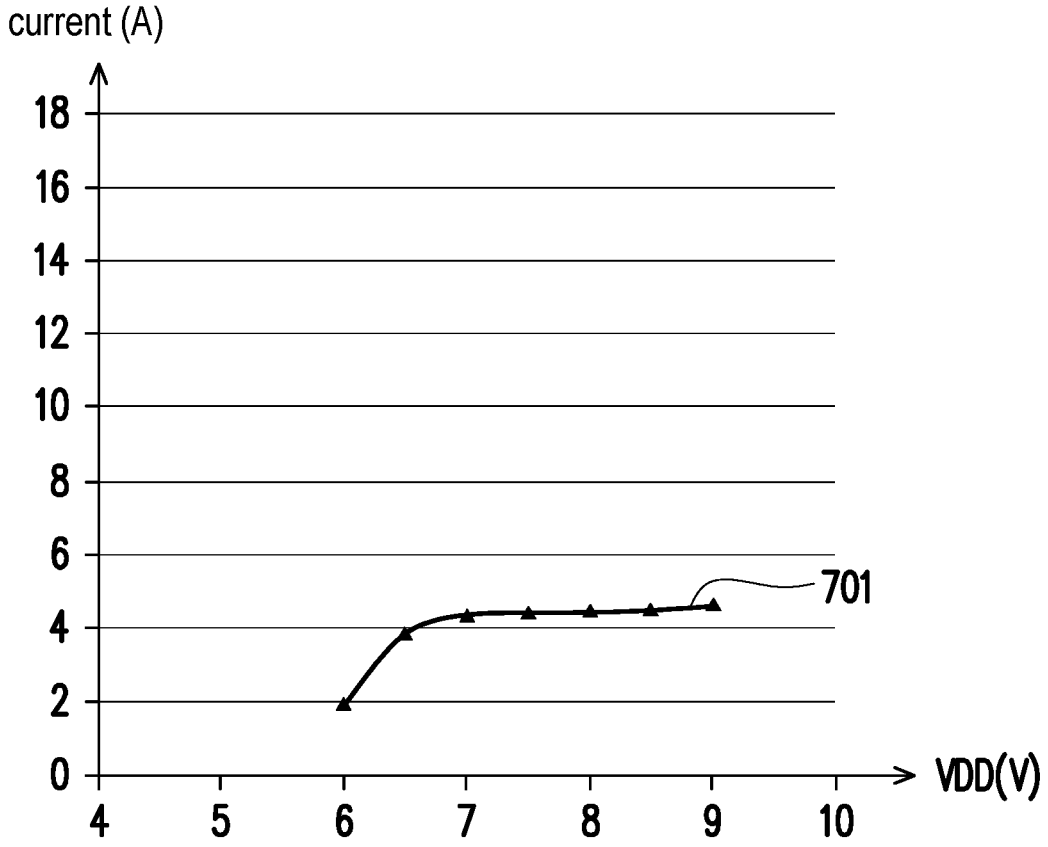
FIG. 7 is a schematic curve diagram of current-voltage according to an embodiment of the disclosure.

FIG. 7 is a schematic curve diagram of current-voltage according to an embodiment of the disclosure. Referring to FIG. 7, a current-voltage curve 701 of FIG. 7 may correspond to the result of the driving circuit 220 of FIG. 2 compensating the transistor T1 through the compensation circuit 225-1 according to the operating voltage VDD, or may correspond to the result of the driving circuit 420 of FIG. 4 compensating the transistor T1 through the compensation circuit 425 according to the operating voltage VDD, or may correspond to the result of the driving circuit 620 of FIG. 6 compensating the transistor T1 through the compensation circuit 625 according to the operating voltage VDD. As shown in FIG. 7, when the transistor T1 enters the saturation region, the current-voltage curve 701 of the transistor T1 can still maintain a stable current value despite the drift of the operating voltage VDD (e.g., between 7V and 9V).

Figure 8:
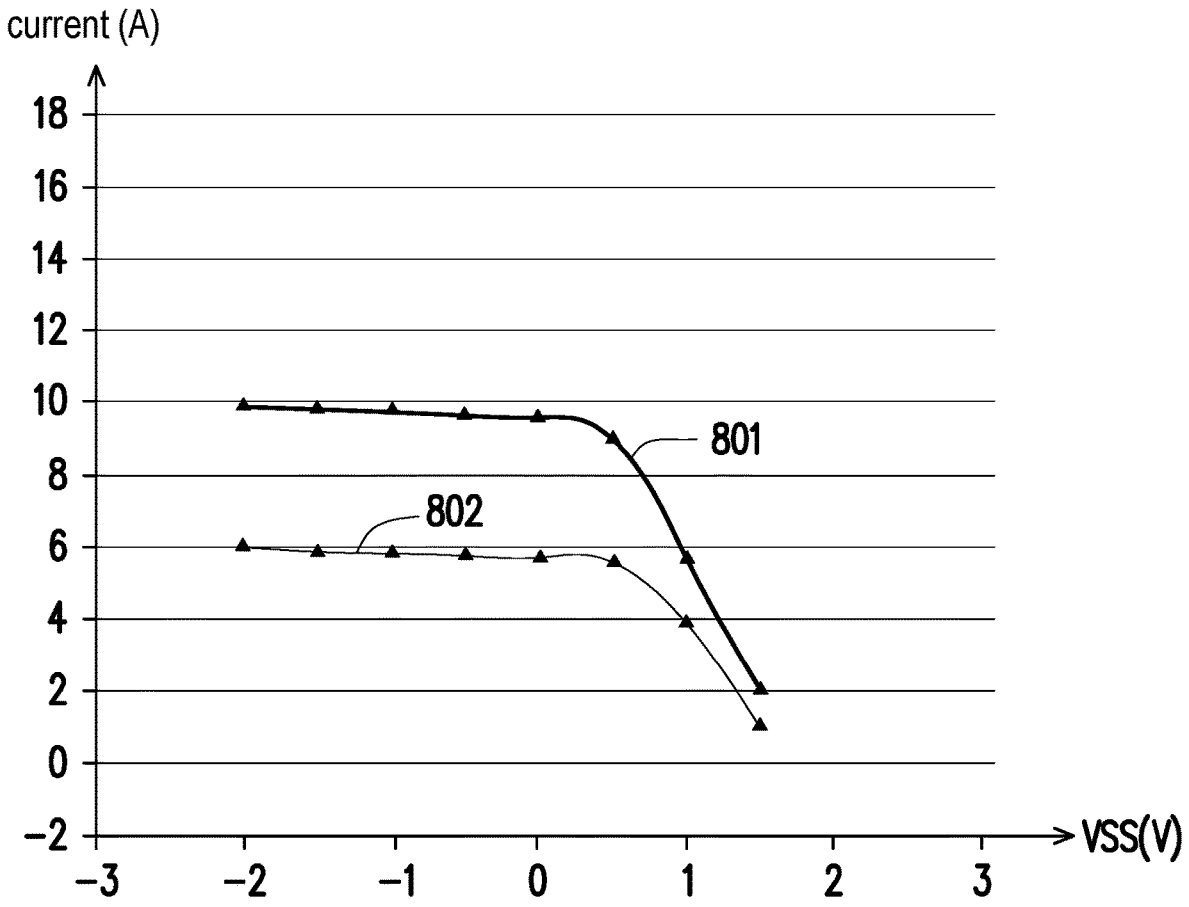
FIG. 8 is a schematic curve diagram of current-voltage according to another embodiment of the disclosure.

FIG. 8 is a schematic curve diagram of current-voltage according to another embodiment of the disclosure. Referring to FIG. 8, a current-voltage curve 801 of FIG. 8 may correspond to the result of the driving circuit 220 of FIG. 2 compensating the transistor T1 through the compensation circuit 225-2 according to the voltage of the anode AN of the light emitting unit 230, or may correspond to the result of the driving circuit 420 of FIG. 4 compensating the transistor T1 through the compensation circuit 425 according to the voltage of the anode AN of the light emitting unit 420, or may correspond to the result of the driving circuit 520 of FIG. 5 compensating the transistor T1 through the compensation circuit 525 according to the voltage of the anode AN of the light emitting unit 530. As shown in the current-voltage curve 801 of FIG. 8, when the transistor T1 enters the saturation region, the current-voltage curve 801 of the transistor T1 can still maintain a stable current value despite the drift of the ground voltage VSS (e.g., between −2V and 0V).

A current-voltage curve 802 of FIG. 8 may correspond to the result of the driving circuit 220 of FIG. 2 compensating the transistor T1 through the compensation circuit 225-2 according to the ground voltage VSS, or may correspond to the result of the driving circuit 420 of FIG. 4 compensating the transistor T1 through the compensation circuit 425 according to the ground voltage VSS, or may correspond to the result of the driving circuit 520 of FIG. 5 compensating the transistor T1 through the compensation circuit 525 according to the ground voltage VSS. As shown in the current-voltage curve 802 of FIG. 8, when the transistor T1 enters the saturation region, the current-voltage curve 802 of the transistor T1 can still maintain a stable current value despite the drift of the ground voltage VSS (e.g., between −2V and 0V).

In addition, when analyzing or providing evidence for electronic products, if the driving circuit of the electronic product is provided with a transistor including the compensation circuit as described above or has the current-voltage curve characteristics as shown in FIG. 7 and FIG. 8, the electronic product can be considered as implementing the circuit design structure claimed in this disclosure.

In summary, the driving circuit and the electronic device for driving the light emitting unit of the disclosure can effectively compensate the driving transistor through designing a compensation circuit to couple any node in the driving current path with the first end of the driving transistor, such as the gate, and with transistor switching sequence with the compensation period, so that non-ideal bias, or the influence of the kink effect, or influence of voltage deviation of the operating voltage VDD and the ground voltage VSS may be reduced in the compensation result.

Finally, it should be noted that the above embodiments are intended only to illustrate the technical solutions of the disclosure and not to limit them. Although the disclosure is described in detail with reference to the foregoing embodiments, it will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A driving circuit for driving a light emitting unit, comprising:
- a driving transistor;
- a switch transistor coupled to the driving transistor;
- an emitting transistor coupled between the light emitting unit and the driving transistor;
- a first capacitor coupled to the driving transistor; and
- a first compensation transistor coupled to the first capacitor, wherein a gate terminal of the first compensation transistor and a gate terminal of the emitting transistor receive a same signal.

2. The driving circuit according to claim 1, further comprising:
- a first reset transistor coupled to the first capacitor at one end, and coupled to a reset voltage at another end.

3. The driving circuit according to claim 2, further comprising:
- a second capacitor; and
- a second compensation transistor coupled to an anode of the light emitting unit at one end, and coupled to the second capacitor at another end.

4. The driving circuit according to claim 3, further comprising:
- a second reset transistor coupled to the second capacitor at one end, and coupled to the reset voltage at another end.

5. The driving circuit according to claim 2, further comprising:
- a second capacitor; and
- a second compensation transistor coupled to a cathode of the light emitting unit at one end, and coupled to the second capacitor at another end.

6. The driving circuit according to claim 5, further comprising:
- a second reset transistor coupled to the second capacitor at one end, and coupled to the reset voltage at another end.

7. The driving circuit according to claim 1, further comprising:
- a second compensation transistor coupled to an anode of the light emitting unit at one end, and coupled to the first capacitor at another end.

8. The driving circuit according to claim 1, further comprising:
- a second compensation transistor coupled to a cathode of the light emitting unit at one end, and coupled to the first capacitor at another end.

9. The driving circuit according to claim 1, further comprising:
- a third reset transistor coupled to an anode of the light emitting unit at one end, and coupled to the reset voltage at another end.

10. The driving circuit according to claim 1, wherein the driving transistor, the switch transistor, the emitting transistor and the first compensation transistor are P-type transistors.

11. An electronic device, comprising:

a substrate;

a light emitting unit disposed on the substrate; and a driving circuit disposed on the substrate, wherein the driving circuit drives the light emitting unit, and the driving circuit comprises:

a driving transistor;

a switch transistor coupled to the driving transistor;

an emitting transistor coupled between the light emitting unit and the driving transistor;

a first capacitor coupled to the driving transistor; and a first compensation transistor coupled to the first capacitor, wherein a gate terminal of the first compensation transistor and a gate terminal of the emitting transistor receive a same signal.

12. The electronic device according to claim 11, wherein the driving circuit further comprises:

a first reset transistor coupled to the first capacitor at one end, and coupled to a reset voltage at another end.

13. The electronic device according to claim 12, wherein the driving circuit further comprises:

a second capacitor; and a second compensation transistor coupled to an anode of the light emitting unit at one end, and coupled to the second capacitor at another end.

14. The electronic device according to claim 13, wherein the driving circuit further comprises:

a second reset transistor coupled to the second capacitor at one end, and coupled to the reset voltage at another end.

15. The electronic device according to claim 12, wherein the driving circuit further comprises:

a second capacitor; and a second compensation transistor coupled to a cathode of the light emitting unit at one end, and coupled to the second capacitor at another end.

16. The electronic device according to claim 15, wherein the driving circuit further comprises:

a second reset transistor coupled to the second capacitor at one end, and coupled to the reset voltage at another end.

17. The electronic device according to claim 11, wherein the driving circuit further comprises:

a second compensation transistor coupled to an anode of the light emitting unit at one end, and coupled to the first capacitor at another end.

18. The electronic device according to claim 11, wherein the driving circuit further comprises:

a second compensation transistor coupled to a cathode of the light emitting unit at one end, and coupled to the first capacitor at another end.

19. The electronic device according to claim 11, wherein the driving circuit further comprises:

a third reset transistor coupled to an anode of the light emitting unit at one end, and coupled to the reset voltage at another end.

20. The electronic device according to claim 11, wherein the driving transistor, the switch transistor, the emitting transistor, and the first compensation transistor are P-type transistors.

* * * * *